US007543522B2

(12) United States Patent
Chen

(10) Patent No.: US 7,543,522 B2
(45) Date of Patent: Jun. 9, 2009

(54) ADJUSTABLE FENCE ASSEMBLY FOR CHOP SAW

(75) Inventor: Jung-Huo Chen, Taichung Hsien (TW)

(73) Assignee: Rexon Industrial Corportion Ltd., Taichung Hsien (TW)

( * ) Notice: Subject to any disclaimer, the term of this patent is extended or adjusted under 35 U.S.C. 154(b) by 225 days.

(21) Appl. No.: 11/723,767

(22) Filed: Mar. 22, 2007

(65) Prior Publication Data

US 2007/0221028 A1 Sep. 27, 2007

(30) Foreign Application Priority Data

Mar. 23, 2006 (TW) ..... 95204899 U

(51) Int. Cl.
*B26D 1/19* (2006.01)

(52) U.S. Cl. ..... 83/490; 83/391

(58) Field of Classification Search ..... 83/490, 83/471.2, 471.3, 391, 478; 411/340, 341, 411/342, 354, 535, 536
See application file for complete search history.

(56) References Cited

U.S. PATENT DOCUMENTS 1,487,184 A * 3/1924 Saunier ..... 411/354
1,519,308 A * 12/1924 Hood ..... 411/354
4,011,782 A * 3/1977 Clark et al. ..... 83/471.3
4,292,870 A * 10/1981 Mericle ..... 83/471.2
5,181,448 A 1/1993 Terpstra
5,297,463 A * 3/1994 O'Banion et al. ..... 83/468.3
5,752,422 A 5/1998 Inoue et al.
5,755,148 A 5/1998 Stumpf et al.
5,855,366 A 1/1999 Chang
5,865,079 A * 2/1999 Itzov ..... 83/471.3
5,943,931 A 8/1999 Stumpf et al.
5,957,022 A 9/1999 Stumpf et al.
5,996,460 A * 12/1999 Waite ..... 83/520
6,073,529 A 6/2000 Shibata et al.
6,418,830 B1 * 7/2002 Stumpf et al. ..... 83/468.2
6,425,309 B1 7/2002 Stumpf et al.
6,427,570 B1 * 8/2002 Miller et al. ..... 83/100
6,431,040 B1 * 8/2002 Miller et al. ..... 83/100
6,899,005 B1 5/2005 O'Banion et al.
7,111,537 B2 * 9/2006 Vallone ..... 83/581
2002/0100350 A1 8/2002 Brazell
2002/0166433 A1 * 11/2002 Ceroll et al. ..... 83/471.3
2004/0089125 A1 5/2004 Schoene et al.
2005/0268766 A1 * 12/2005 Chen ..... 83/473
2006/0005677 A1 1/2006 Lambert et al.

(Continued)

*Primary Examiner*—Kenneth E. Peterson
*Assistant Examiner*—Sean Michalski
(74) *Attorney, Agent, or Firm*—Bacon & Thomas, PLLC

(57) ABSTRACT

A fence assembly of a cut-off machine includes a fence base fixed above a worktable of the cut-off machine, a fence plate supported on and movable along the fence base, having a downwardly extending bottom panel and a locking structure for controlling whether the fence plate is locked to the fence base. The locking structure includes a fastener defining a separation with a constant length from the fence base, a first block, a second block and a press member. The first block, the second block and the bottom panel are positioned in the constant separation. The bottom panel is disposed between the second block and the fence base. The contact surface between the first block and the second block slopes toward the direction of the separation. The first block is movable substantially perpendicularly to the direction of the separation. The press member selectively presses the first block.

13 Claims, 8 Drawing Sheets

U.S. PATENT DOCUMENTS

2006/0086225 A1 4/2006 Xin
2006/0174739 A1* 8/2006 Chaikowsky ..... 83/471.3
2006/0236833 A1* 10/2006 Meredith et al. ..... 83/471.3
2006/0266184 A1* 11/2006 Hetcher et al. ..... 83/471.3
2008/0295663 A1* 12/2008 Hsieh et al. ..... 83/471.3

* cited by examiner

ADJUSTABLE FENCE ASSEMBLY FOR CHOP SAW

BACKGROUND

1. Field of the Invention

The present invention relates to a cut-off machine and more specifically, to a fence assembly for a cut-off machine.

2. Description of the Related Art

Referring to FIG. 8, a conventional cut-off machine 50 includes a worktable 51, a saw arm 52, a saw blade 53 and a fence assembly 60. The worktable 51 may be made in a fixed form or rotatable form. The worktable 51 shown in FIG. 8 is a rotatable form, including a rotating table 54 and a fixed table 55. The fence assembly 60 is installed on the fixed table 55 and extends over the rotating table 54, and further having a lateral side perpendicular to the top surface of the rotating table 54. The saw arm 52 has one end pivotally or rotatably connected to the rear side of the rotating table 54, and the other end holding the saw blade 53. The workpiece to be cut is placed on the worktable 51 at a suitable location. When lowering the saw arm 52, the saw blade 53 cuts the workpiece. For accurate cutting, the workpiece must be stopped against the fence assembly 60. The fence assembly 60 holds the workpiece disposed in place, as a reference for positioning. Based on the reference position at the fence assembly 60 being correlated to match with graduations 56 on the front edge of the fixed table 55 and an indicator 57 on the front side of the rotating table 54, the user can know the cutting angle of the saw blade 53 and can rotate the rotating table 54 to adjust the cutting angle.

Referring to FIG. 8 again, the fence assembly 60 is adjustable in length to fit different workpieces having different lengths and dimensions. The fence assembly 60 includes a top fence plate 61 and a bottom fence plate 62. The top fence plate 61 is above the top side of the bottom fence plate 62, and movable along the bottom fence plate 62 to adjust the length of the fence assembly 60. As shown in FIG. 7, the bottom fence plate 62 defines a sliding groove 621. The top fence plate 61 has a bottom extension 611 inserted into the sliding groove 621 of the bottom fence plate 62, and a locating groove 612 formed on the right side of the bottom extension 611. A first bolt 63 is fastened to the right side of the bottom fence plate 62 and inserted into the locating groove 612 of the top fence plate 61. A second bolt 64 is screwed through the left side of the bottom fence plate 62 and stopped against the left side of the bottom extension 611. When the second bolt 64 is loosened, the top fence plate 61 is unfixed and movable along the sliding groove 621 of the bottom fence plate 62. When the second bolt 64 is fastened or tightened, the second bolt 64 presses bottom extension 611 of the top fence plate 61 against the bottom fence plate 62. When operating the fence assembly 60, the user must move their hand between the top fence plate 61 and the second bolt 64. According to this design, it is time-consuming to adjust the length of the fence assembly 60.

SUMMARY

The present invention has been accomplished to provide a fence assembly for a cut-off machine, which eliminates the drawbacks of the aforesaid conventional design.

According to an embodiment disclosed in the present invention, the fence assembly is installed in a cut-off machine and disposed on a worktable of the cut-off machine for stopping a workpiece in position on the worktable to be cut by the cut-off machine. The fence assembly includes a fence base, a fence plate, a locking structure and a press member. The fence base is fixedly provided above the worktable of the cut-off machine. The fence plate is supported on and movable along the fence base, having a downwardly extending vertical bottom panel. The locking structure for controlling whether the fence plate is locked to the fence base includes a fastener defining a separation with a constant length from the fence base, a stop block, a locating block, and a press member. The stop block, the locating block and the bottom panel of the fence plate are positioned in the constant separation. The bottom panel of the fence plate is disposed between the locating block and the fence base. The contact surface between the stop block and the locating block slopes at an angle to the direction of the separation. The stop block is movable substantially perpendicularly to the direction of the separation. The press member selectively presses against the stop block to prevent the movement of the stop block.

When the press member presses the stop block, the fastener provides a clamping force that holds the stop block, the locating block, the fence plate and the fence base together. The stop block is stopped from moving upwardly, and the bottom panel of the fence plate is firmly sandwiched between the locating block and the fence base, prohibiting sliding movement of the fence plate along the fence base. When the press member is operated so as not to press the stop block and thus make the stop block moved upwardly, slightly, the clamping force of the fastener is removed or reduced so as to allow sliding movement of the fence plate relative to the fence base. Further, releasing the press member will fasten the fence plate again by returning the press member and the stop block to their former positions. This design is convenient to use.

DETAILED DESCRIPTION

Figure 1:
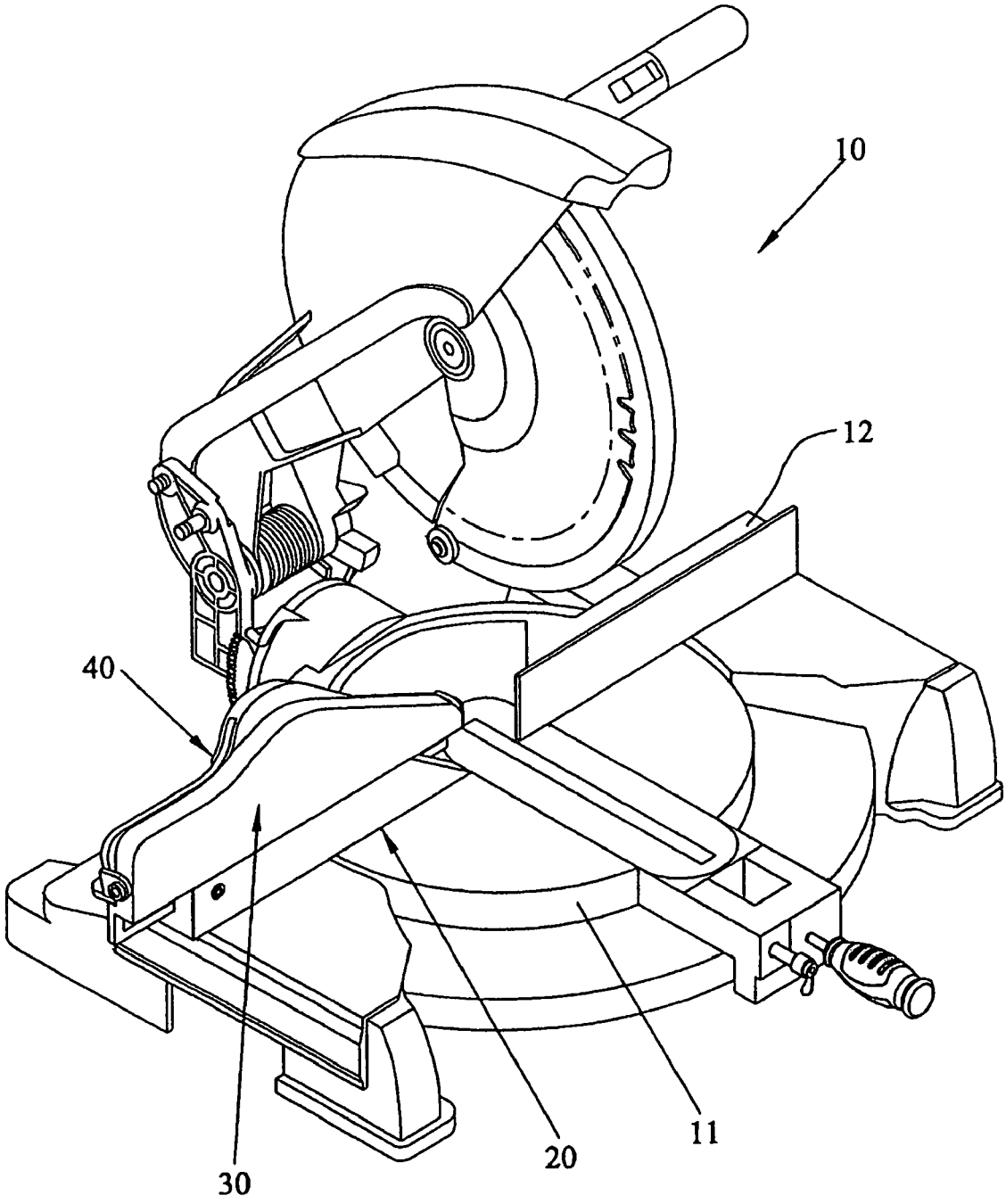
FIG. 1 is a perspective view showing a fence assembly installed in a cut-off machine according to an embodiment of the present invention.
Figure 2:
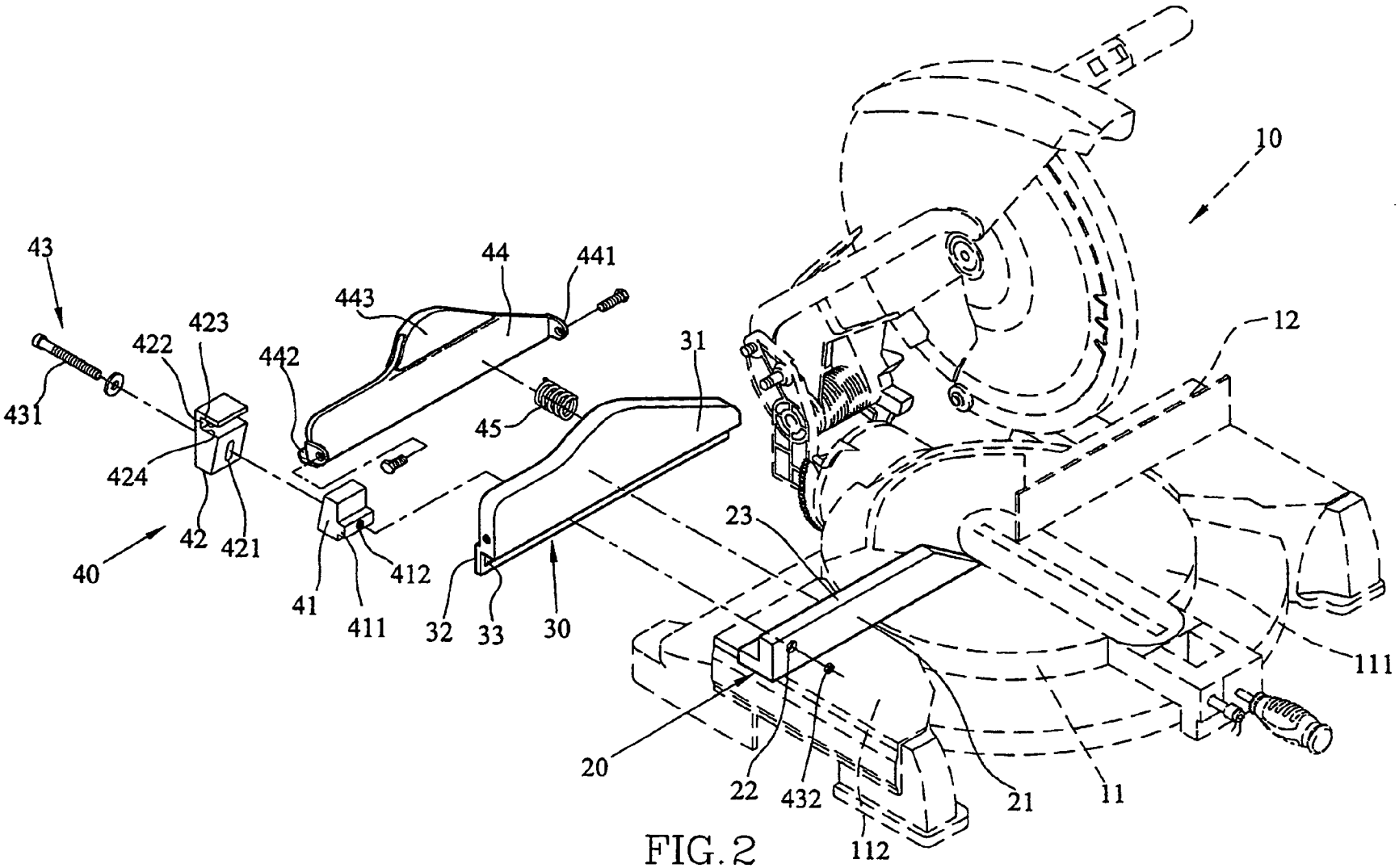
FIG. 2 is an exploded view of the fence assembly according to the embodiment of FIG. 1.
Figure 3:
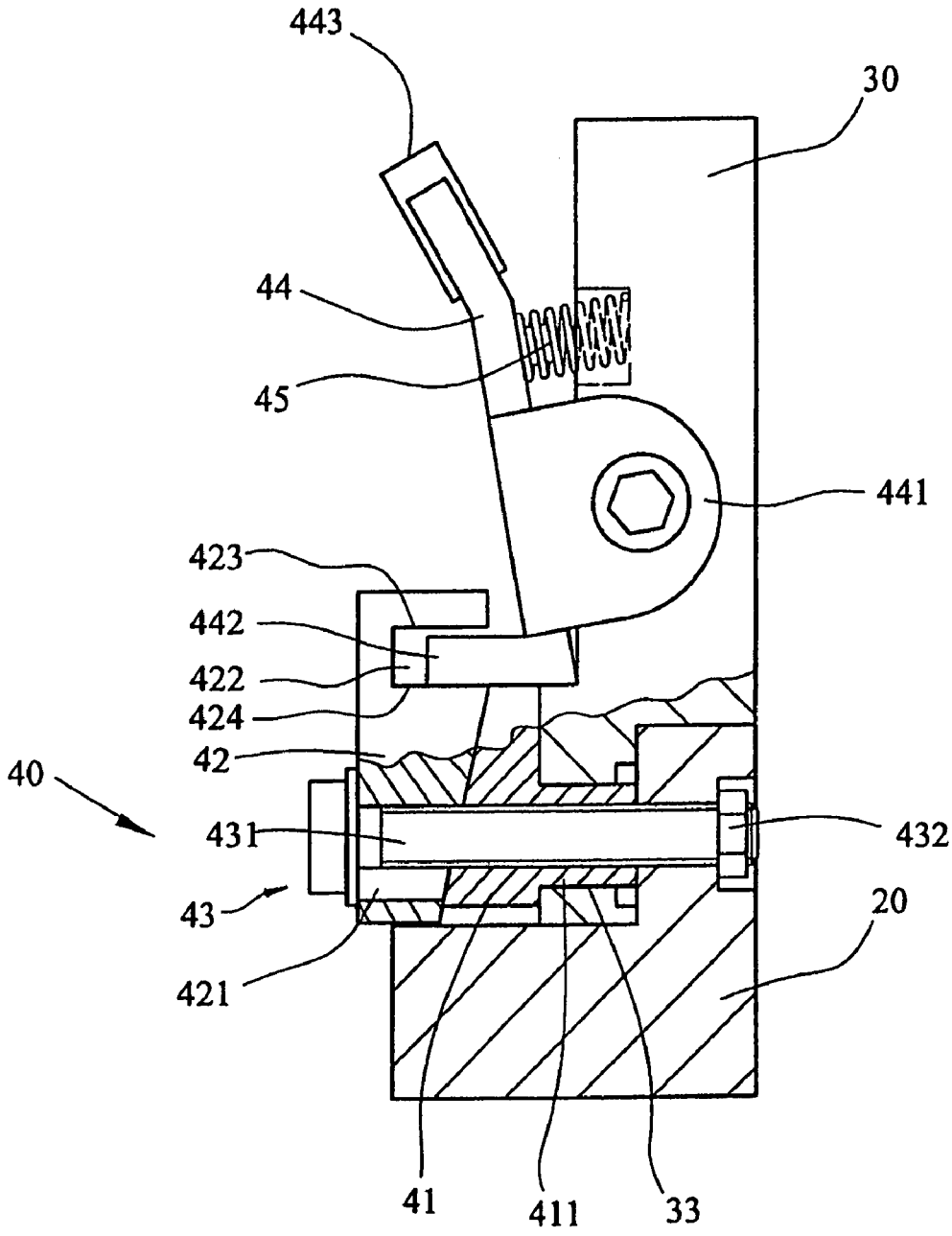
FIG. 3 is a schematic sectional view of the fence assembly according to the embodiment of FIG. 1, showing a fence plate locked to a fence base.
Figure 4:
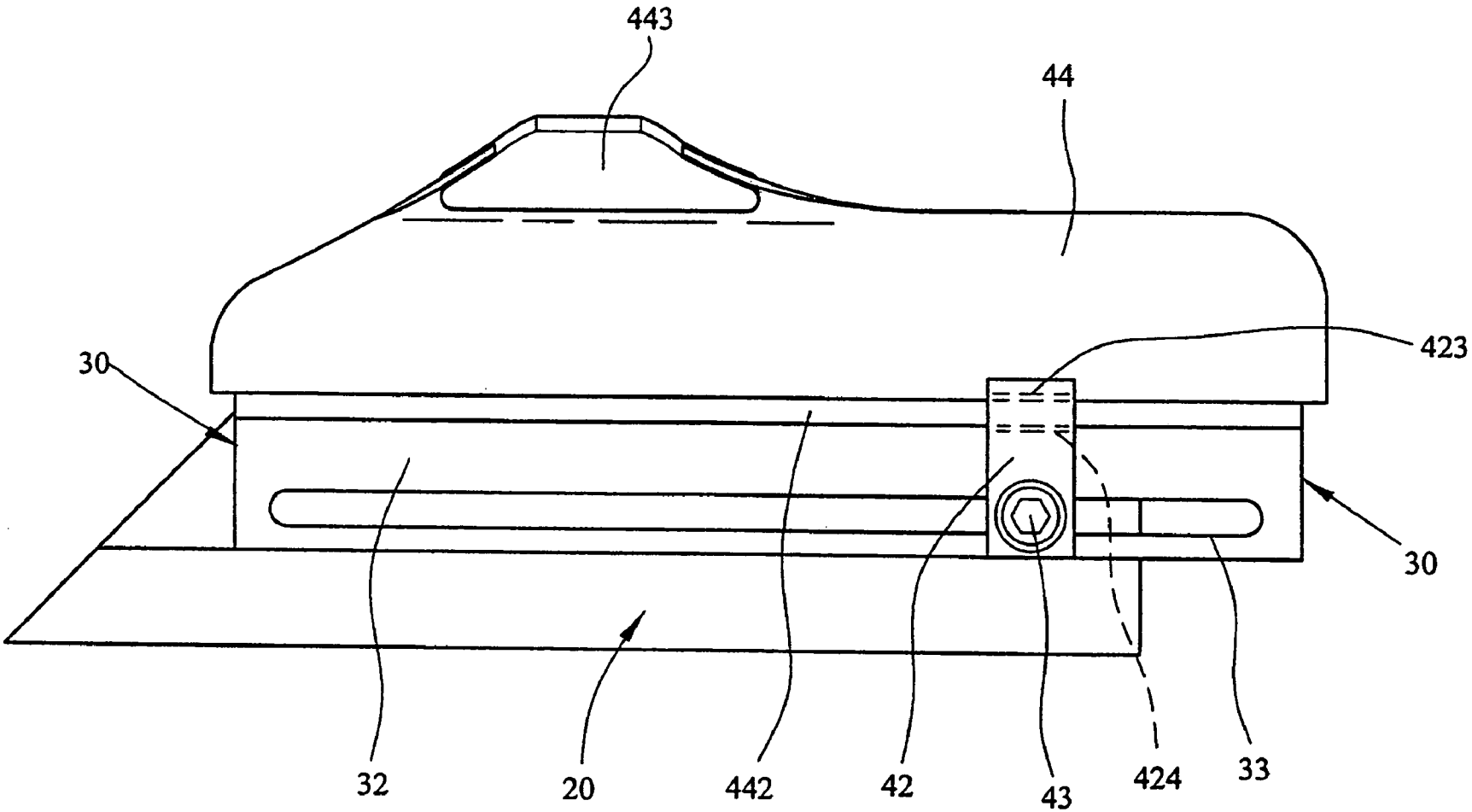
FIG. 4 is a schematic rear view of the fence assembly according to the embodiment of FIG. 1.

Referring to FIGS. 1~4, a fence assembly 12 in accordance with the present invention is shown installed in a cut-off machine 10. According to an embodiment, the cut-off machine 10 includes a worktable 11. The fence assembly 12 is provided on the top side of the worktable 11 for stopping a workpiece put on the worktable 11 in a position to be cut by the cut-off machine 10.

The fence assembly 12 includes a fence base 20, a fence plate 30 mounted on the fence base 20, and a locking structure 40. The aforesaid worktable 11 may be made in a fixed form or rotatable form. The fence assembly 12 is applicable to either a fixed form or rotatable form of the worktable. According to this embodiment, the worktable 11 is a rotatable design including a fixed table 112 and a rotating table 111 rotatably supported on the fixed table 112. The fence base 20 is fixedly mounted on the fixed table 112 and extends over the top side of the rotating table 111, and further having an upright sidewall 21 perpendicular to the top side of the rotating table 111 and a through hole 22 drilled through the fence base 20 from the upright sidewall 21 near one end of the sidewall 21.

The fence plate 30 is provided above the top side 23 of the fence base 20, and further having a vertical top panel 31 arranged in parallel to and in flush with the upright sidewall 21 of the fence base 20, a vertical bottom panel 32 downwardly extending from the bottom side of the vertical top panel 31 in parallel to the upright sidewall 21, and a sliding slot 33 formed on the bottom panel 32 along the length direction of the bottom panel 32. The vertical top panel 31 is mounted above the upright sidewall 21 of the fence base 20 in flush with one side, namely, the outer side of the fence base 20. The vertical bottom panel 32 is closely attached to the other side, namely, the inner side of the fence base 20. The sliding slot 33 formed on the bottom panel 32 corresponds to the through hole 22 of the fence base 20.

The locking structure 40 includes a locating block 41, a stop block 42, a fastener 43, a press member 44 and an elastic member 45. The locating block 41 has a locating flange 411 extending from a first lateral side. The vertical width of the locating flange 411 fits the width of the sliding slot 33 of the fence plate 30 so that the locating flange 411 can be fitted into the sliding slot 33 of the fence plate 30 and kept stably in contact with the fence plate 30. The other, second lateral side of the locating block 41 opposite to the first lateral side from which the locating flange 411 extends, is a sloping side. The width between the two opposite lateral sides of the locating block 41 reduces gradually upwardly. The locating block 41 further has a through hole 412 drilled through the locating flange 411 and its two opposite lateral sides.

The stop block 42 has a sloping lateral side corresponding with the slope of the sloping lateral side of the locating block 41 so that the stop block 42 and the locating block 41 can be matched together. The stop block 42 has a vertically extending through hole 421 drilled through its two opposite lateral sides and a locating groove 422 formed on its top part above the vertically extending through hole 421. The locating groove 422 has a top wall 423 and a bottom wall 424. Further, an open side of the locating groove 422 is positioned toward the locating block 41.

The fastener 43 according to this embodiment includes a bolt 431 and a nut 432. The bolt 431 is inserted in proper order through the vertically extending through hole 421 of the stop block 42, the through hole 412 of the locating block 41 and the through hole 22 of the fence base 20, and then screwed into the nut 432. The through hole 412 of the locating block 41 and the through hole 22 of the fence base 20 have a diameter corresponding to the diameter of the cross section of the bolt 431 so that the locating block 41 and the fence plate 30 are prohibited from vertical displacement relative to the bolt 431. However, because the through hole 421 of the stop block 42 is a vertically extending long hole, the stop block 42 is allowed to have vertical displacement relative to the bolt 431.

The press member 44 has two lugs 441 respectively perpendicularly extending from its two distal ends toward the fence plate 30 and pivotally coupled to the two distal ends of the fence plate 30. The elastic member 45 according to this embodiment is a spring member connected between the press member 44 and the vertical top panel 31 of the fence plate 30 above the elevation of the lugs 441. The press member 44 further has a protruding portion 442 extending from its bottom side and inserted into the locating groove 422 of the stop block 42.

When the user does not press the press member 44, the elastic member 45 biases the press member 44 outwards from the fence plate 30. At this time, the protruding portion 442 of the press member 44 inserted into the locating groove 422 of the stop block 42 presses on the bottom wall 424 of the locating groove 422 to prohibit upward displacement of the stop block 42. When tightening the fastener 43, the fastener 43 provides a clamping area that provides a clamping force to the stop block 42 and the fence base 20 from two opposite sides thereof. The length of this clamping area is from the head of the bolt 431 to the fence base 20. At this time, the contact surface between the locating block 41 and the stop block 42 slopes at an angle to the direction of the clamping force. Because of the limitation of the protruding portion 442 of the press member 44, the stop block 42 is prohibited from upward displacement. Therefore, the stop block 42, the locating block 41, the fence plate 30 and the fence base 20 are firmly secured together, and the vertical bottom panel 32 of the fence plate 30 is firmly sandwiched between the locating block 41 and the fence base 20, thus prohibiting sliding movement of the fence plate 30 relative to the fence base 20 by means of sliding slot 33.

Figure 5:
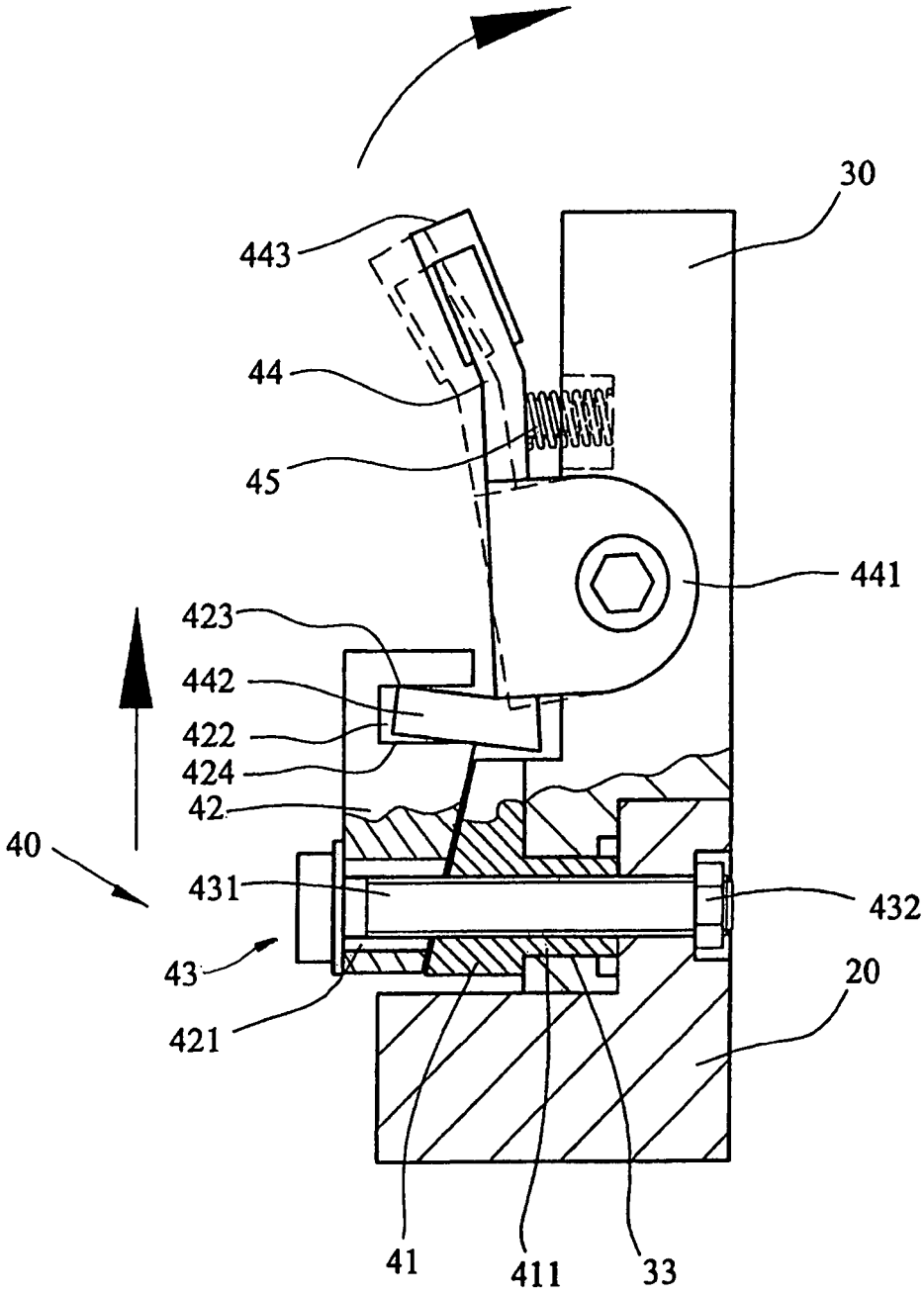
FIG. 5 is a view similar to FIG. 3, showing the press member in a pressed position.
Figure 6:
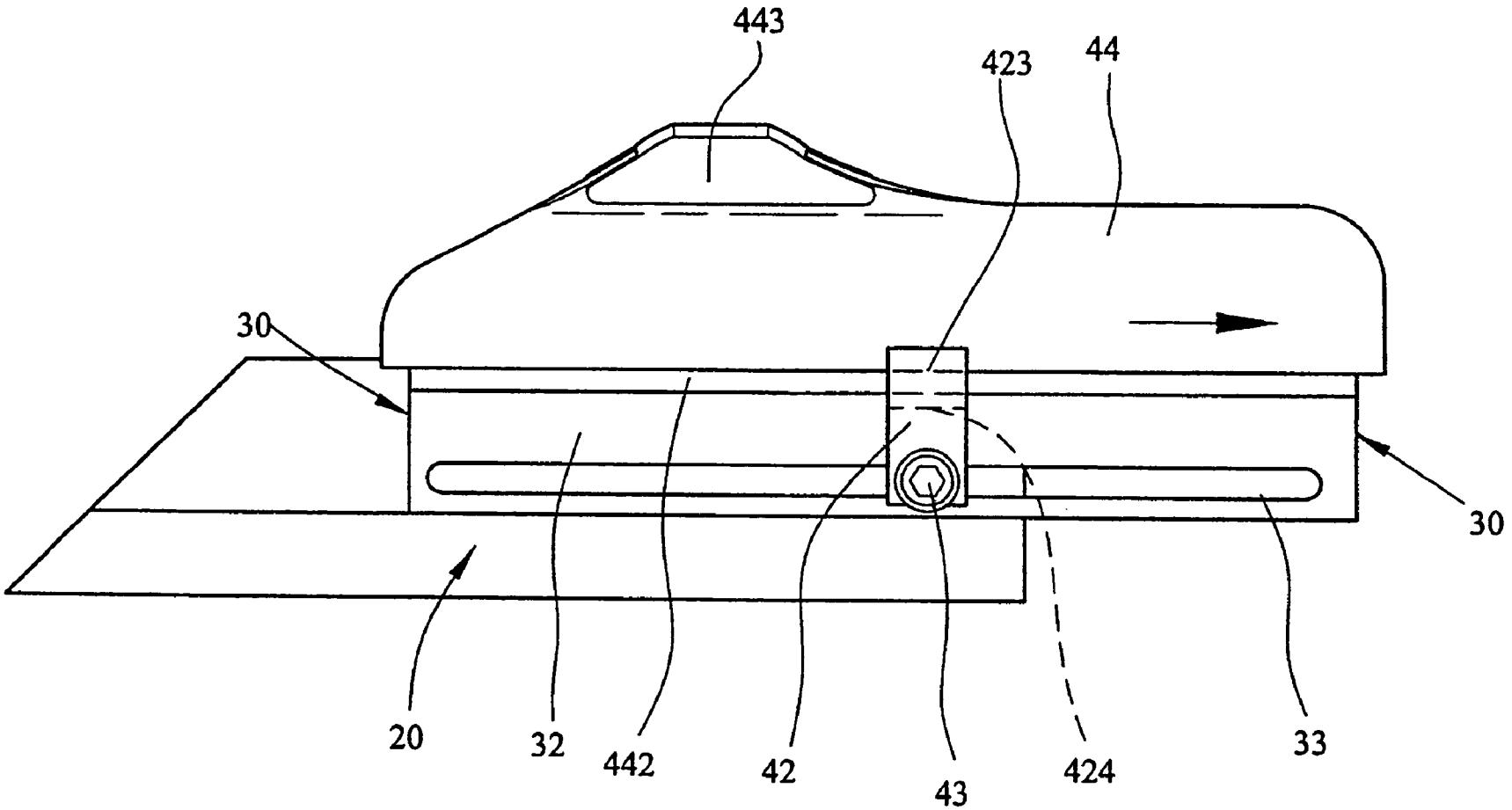
FIG. 6 is a view similar to FIG. 4, showing the fence plate unlocked and moved relative to the fence base.
Figure 7:
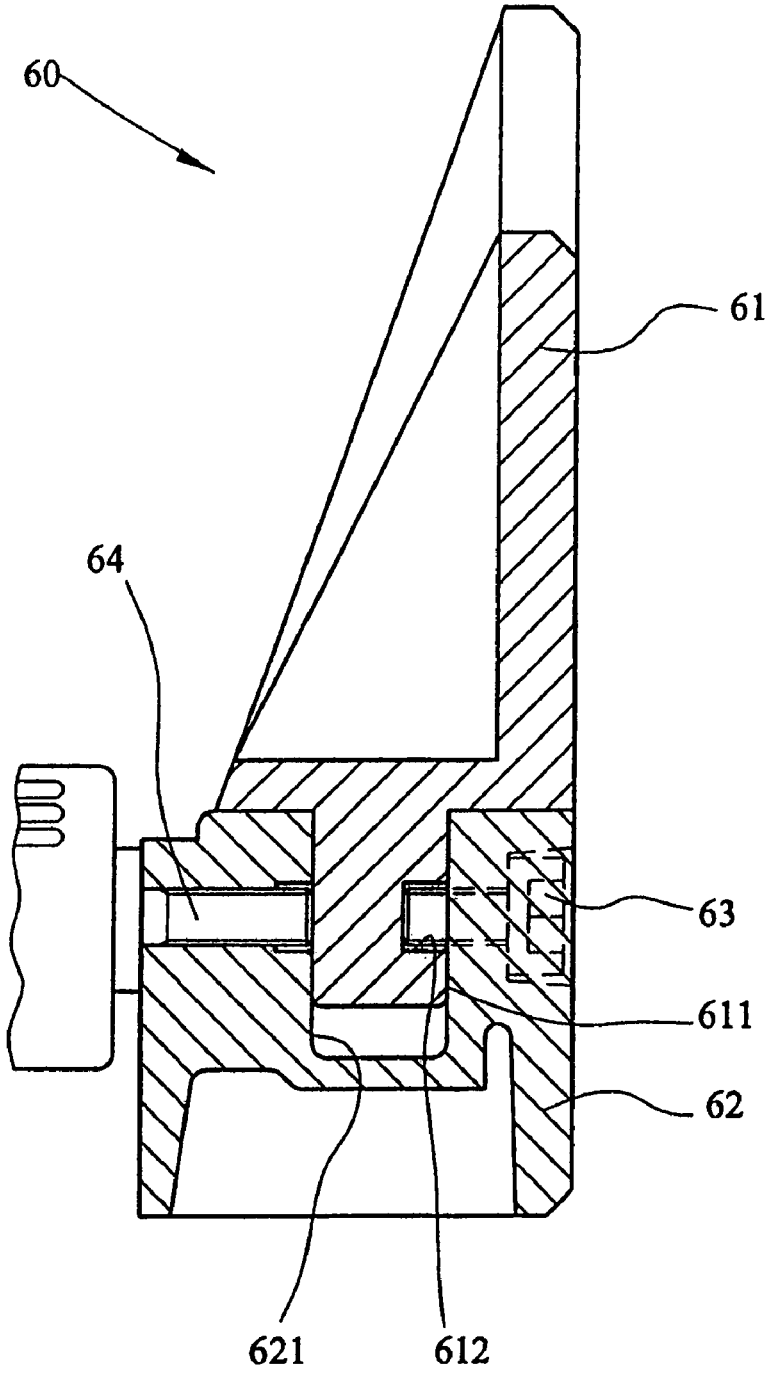
FIG. 7 PRIOR ART
FIG. 7 is a sectional view of a fence assembly according to the prior art.
Figure 8:
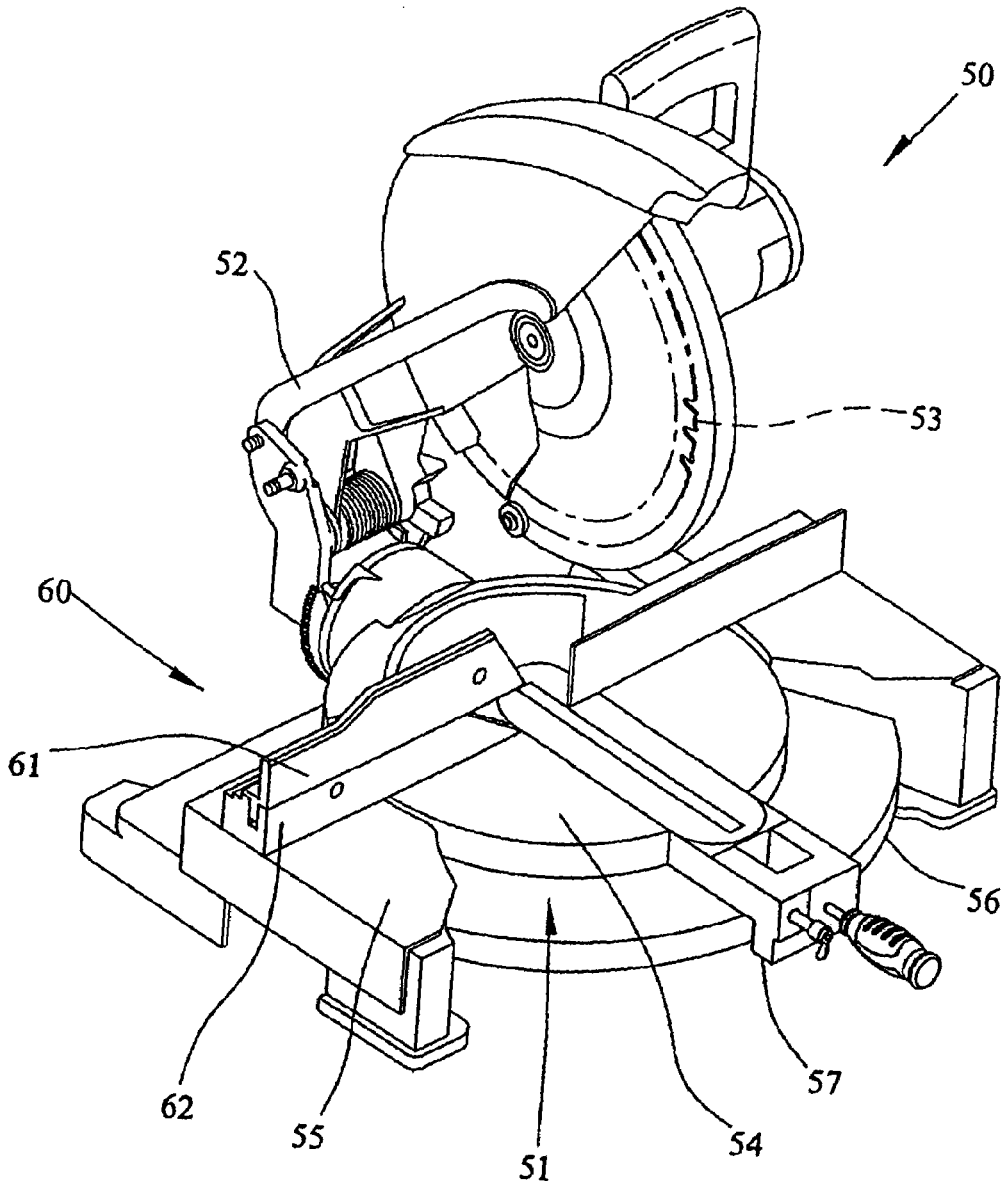
FIG. 8 PRIOR ART
FIG. 8 is a perspective view of a conventional cut-off machine.

Referring to FIGS. 5 and 6, when wishing to move the fence plate 30 relative to the fence base 20 and to further adjust the length of the fence assembly 12, a user presses the top portion 443 of the press member 44 to make the top portion 443 pivot toward the fence plate 30 against the bias of the elastic member 45. At this time, the protruding portion 442 is moved toward the top wall 423 of the locating groove 422 to push the top wall 423 so as to lift the stop block 42. Because the length of the clamping area is constant, a gap appears between stop block 42 and the locating block 41 after the stop block 42 is lifted to result in the disappearance of the clamping force. Therefore the fence plate 30 can be moved relative to and along the fence base 20.

Further, because the periphery of the sliding slot 33 is kept in contact with the locating flange 411 of the locating block 41 but not the bolt 431, the contact length between the periphery of the sliding slot 33 and the locating flange 411 of the locating block 41 is long enough to support stable sliding movement of the fence plate 30 relative to the fence base 20 guided by the sliding slot 33. Moreover, the top portion 443 of the press member 44 curves slightly outwards in order to increase its distance from the fence plate 30, thus facilitating operation.

As stated above, the contact surface between the locating block 41 and the stop block 42 slopes at an angle to the direction of the clamping force of the fastener 43. When the fastener 43 is tightened, and the press member 44 presses the stop block 42, the stop block 42, the locating block 41, the fence plate 30 and the fence base 20 are firmly secured together. As a result, the stop block 42 is stopped from moving upwardly, and the vertical bottom panel 32 of the fence plate 30 is firmly sandwiched between the locating block 41 and the fence base 20, thus prohibiting sliding movement of the fence plate 30 relative to the fence base 20. When wishing to adjust the length of the fence assembly 12, a user simply presses the press member 44 in order to lift the stop block 42 to have the clamping force of the fastener 43 disappear, so as to allow sliding movement of the fence plate 30 relative to the fence base. After releasing the press member 44, the elastic member 45 immediately returns the press member 44 to its former position to fasten the fence plate 30. This design is convenient to use. Further, the press member 44 has a curved top portion in order to facilitate operation.

The invention being thus described, it will be apparent to a skilled artisan that the same may be varied in many ways. Such variations are not to be regarded as a departure from the spirit and scope of the invention, and all such modifications as would be obvious to one skilled in the art are intended to be included within the scope of the following claims.

What is claimed is:

1. A fence assembly installed in a cut-off machine and disposed on a worktable of the cut-off machine for stopping a workpiece on the worktable in position to be cut by the cut-off machine, the fence assembly comprising:

a fence base fixedly provided above the worktable of the cut-off machine;

a main fence device supported on the fence base; and a locking structure for controlling whether the main fence device is locked to the fence base, the locking structure comprising a fastener defining a separation with a constant length from the fence base, a first block, wherein the first block and a bottom part of the main fence device are positioned in the separation, the bottom part of the main fence device is disposed between the first block and the fence base, a contact surface between the first block and the bottom part of the main fence device slopes toward the direction of the separation, and the first block is movable substantially perpendicularly to the direction of the separation, and a press member selectively pressing the first block to prevent the movement of the first block.

2. The fence assembly as claimed in claim 1, wherein the main fence device comprises a fence plate movable along the fence base, and the bottom part of the main fence device comprises a bottom panel of the fence plate and a second block, wherein the bottom panel is disposed between the second block and the fence base, and the contact surface between the first block and the bottom part of the main fence device is a contact surface between first block and the second block.

3. The fence assembly as claimed in claim 2, wherein the fence base has an upright sidewall perpendicular to a top surface of the worktable on which the workpiece is supported.

4. The fence assembly as claimed in claim 3, wherein the fence plate has a top panel above and in flush with the upright sidewall of the fence base.

5. The fence assembly as claimed in claim 2, wherein the bottom panel of the fence plate has a sliding slot, and the second block has a locating flange extending from one side thereof and passing through the sliding slot of the fence plate, the locating flange spanning a width of the sliding slot.

6. The fence assembly as claimed in claim 2, wherein the first block defines a vertically extending through hole therein for the passing of the fastener.

7. The fence assembly as claimed in claim 6, wherein the fastener comprises a bolt inserted through the first block, the second block, the bottom panel of the fence plate and the fence base, the bolt having a head stopped at one side of one of the first block and the fence base, and a nut threaded onto the bolt and stopped at one side of the other one of the first block and the fence base.

8. The fence assembly as claimed in claim 2, wherein the press member is pivotally attached to the fence plate with at least one pivotal joint, and the locking structure further has an elastic member disposed between the press member and the fence plate above the at least one pivotal joint of the press member to bias the press member apart from the fence plate and against the first block.

9. The fence assembly as claimed in claim 8, wherein the first block provides a locating groove in a top portion thereof, and the press member has a protruding portion inserted into the locating groove.

10. The fence assembly as claimed in claim 9, wherein the protruding portion extends from a bottom side of the press member.

11. The fence assembly as claimed in claim 9, wherein the locating groove of the first block has a top wall and a bottom wall, the protruding portion of the press member pushes the top wall of the locating groove to lift the first block relative to the fastener when the press member is pivoted by an external force to compress the elastic member, and the elastic member biases the press member to cause the protruding portion to press against the bottom wall when the external force removed.

12. The fence assembly as claimed in claim 8, wherein the press member has a top portion curved outwards.

13. The fence assembly as claimed in claim 2, wherein the contact surface between the first block and the second block slopes at an angle to the direction of the separation.

* * * * *